US005491840A

United States Patent [19]

Yen

[11] Patent Number: 5,491,840

[45] Date of Patent: Feb. 20, 1996

[54] BUFFER STRUCTURE FOR SHIN PROTECTION AND ANKLE SLEEVE MAT

[75] Inventor: Fu-Hsin Yen, Pan-Chau, Taiwan

[73] Assignee: Comax Sporting Goods Co., Ltd., Taipei, Taiwan

[21] Appl. No.: 79,365

[22] Filed: Jun. 17, 1993

[51] Int. Cl.[6] ..... A41D 13/00

[52] U.S. Cl. ..... 2/2; 2/16; 2/24

[58] Field of Search ..... 2/16, 22, 23, 24, 2/45, 410, 411, 416, 2, 2.5; 602/5, 12, 23

[56] References Cited

U.S. PATENT DOCUMENTS

| | | | |
|---|---|---|---|
| 1,688,676 | 10/1928 | Whitley | 2/22 |
| 1,689,558 | 10/1928 | Patten . | |
| 1,744,384 | 1/1930 | Hood . | |
| 1,772,922 | 8/1930 | Volz | 2/22 |
| 1,784,148 | 12/1930 | Levinson . | |
| 1,931,524 | 10/1933 | Becket | 2/22 |
| 2,250,275 | 7/1941 | Riddell | 2/416 |
| 2,338,424 | 1/1944 | Giardini . | |
| 4,463,456 | 8/1984 | Hanson | 2/416 |

FOREIGN PATENT DOCUMENTS

| | | |
|---|---|---|
| 548786 | 6/1930 | Germany . |
| 602645 | 5/1948 | United Kingdom . |

*Primary Examiner*—C. D. Crowder
*Assistant Examiner*—Gloria Hale
*Attorney, Agent, or Firm*—Fish & Richardson

[57] ABSTRACT

A buffer structure improvement of a body part protector having a pad, and a board having a generally arcuate cross-section with a string. Between the pad and the board is a buffer web attached to the board with a buffer spacing between the web and the board.

8 Claims, 4 Drawing Sheets

BUFFER STRUCTURE FOR SHIN PROTECTION AND ANKLE SLEEVE MAT

BACKGROUND OF THE INVENTION

The present invention relates to a body part protector.

Sports have become a widely accepted activity. Sports, such as football, hockey, and baseball, require use of many parts of the body. The shin, elbow, wrist, ankle, hip, shoulder, knee, and thigh, for example, are thus susceptible to damage by the impact of the external forces. Sports regulations typically require the player to wear appropriate body part protectors to reduce injuries, to lower the chances of wounds and to generally safeguard the player.

As shown in FIG. 1, a known protector for the shin (or elbow) includes a shin pad 11, ankle sleeve 12, plastic hardboard 13, and a string 14. Shin pad 11 is a soft matrix or a matrix filled with sponge. Ankle sleeve 12 is connected at the lower end of shin pad 11, and plastic hardboard 13 is fixed to the back of the shin pad 11 to resist external impact. Although the plastic hardboard 13 can resist external impact force, the shin pad is soft. Therefore, an external force which impacts the hardboard is transferred by the hardboard directly onto the shin. Also, the arc shape of the surface of the hardboard (which allows it to fit closely to the shin) causes the impacting force to extend and concentrate from the central peak of the arc to the edges. This may cause harm to the shin and raises the probability of a wound.

SUMMARY OF THE INVENTION

The main objective of the present invention is to provide a improvement to a body part protector which offers an optimum elastic buffer effect with the protector pad to reduce the effect of the external impact force and safely protect the body part.

In general, the invention features a buffer structure improvement of a body part protector having a pad, and a board having a generally arcuate cross-section with a string. The improvement is characterized in that between the pad and the board is a buffer web attached to the board with a buffer spacing between the web and the board.

Embodiments of the invention include the following features.

The buffer web is elastic, lies in a plane, and is formed by threads attached to the board.

The board is rigid.

The buffer web may be a plastic material formed as a unit with the board, or a separately formed piece sewn to the board.

The pad, the board, and the web are configured to protect one of the following body parts: shin, knee, ankle, elbow, shoulder, hip, thigh, or forearm/hand.

Other advantages and features will become apparent from the following description and from the claims.

DESCRIPTION

Figure 1:
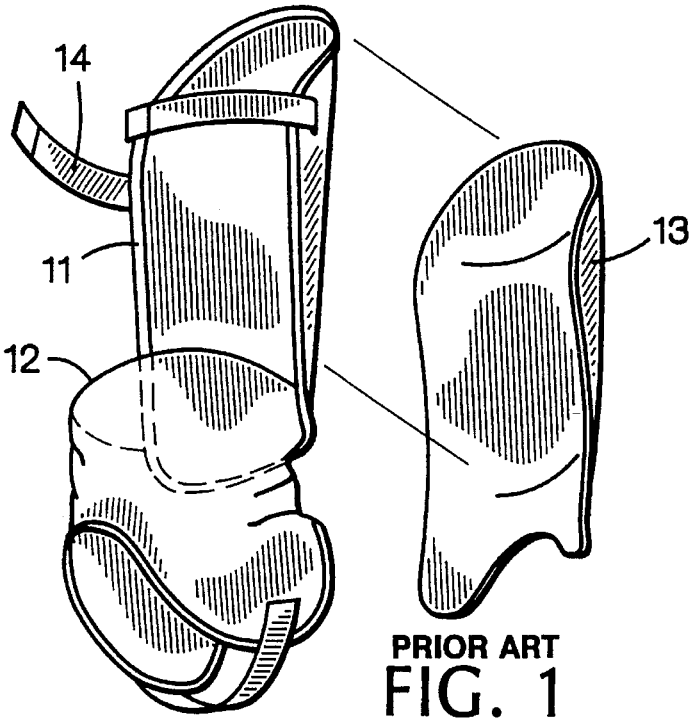
PRIOR ART FIG. 1
FIG. 1 is an exploded perspective view of a prior art shin/ankle protector.
Figure 3:
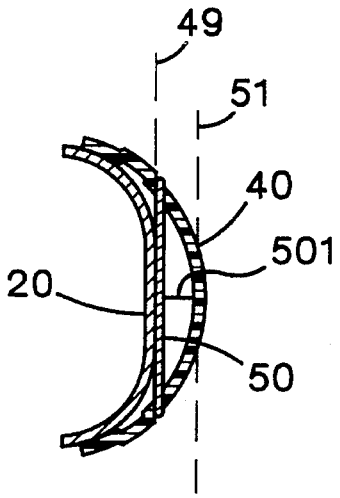
FIG. 3 is a cross-sectional view of the improved shin/ankle protector.
Figure 2:
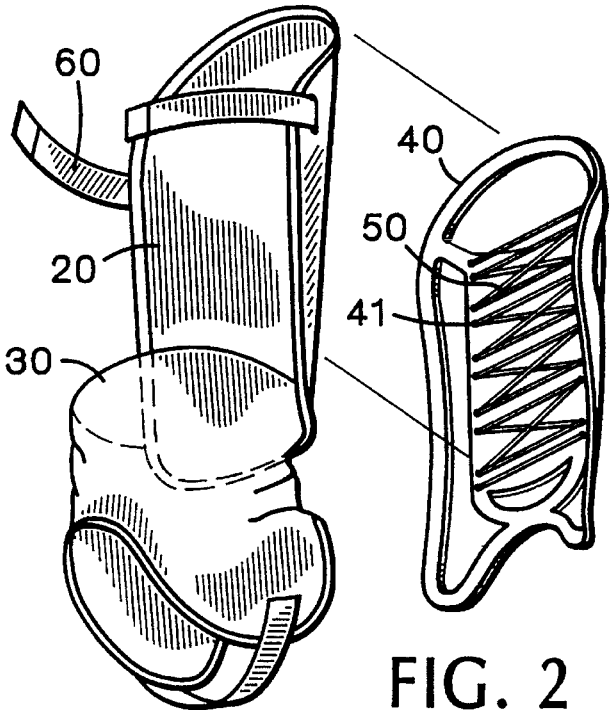
FIG. 2 is an exploded perspective view of an improved shin/ankle protector.

As shown in FIGS. 2 and 3, an improved shin/ankle protector includes shin pad 20, ankle sleeve 30, hardboard body 40, and buffer web 50 as well as string 60. Shin pad 20 is a soft matrix. Ankle sleeve 30 is connected at the lower end of shin pad 20; sleeve 30 is sleeved onto the ankle of the human leg. String 60 is attached to the shin pad 20 and used to string the shin/ankle protector onto the shin. Hardboard body 40, an arc-shaped plastic board, is connected onto the outside face of the shin pad 20. The two sides of the plastic board are symmetrically arranged and have two rows of stringing holes 41.

Buffer web 50 is made of the nylon threads slidably strung through holes 41 of hardboard 40 to form a web. The plane of the web 49 is separated from the plane of the board 51 by a spacing 501.

Figure 4:
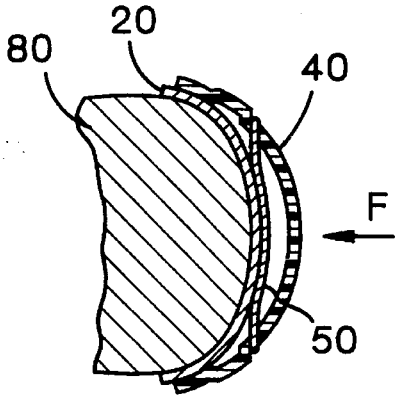
FIG. 4 is a cross-sectional view of improved shin/ankle protector attached to a leg.

In FIG. 4, the structure places the buffer web 50 between the shin pad 20 and hardboard 40. Hardboard 40 has good impact resistance and can resist much of the impact F. The soft shin pad 20 comfortably conforms to the contour of the shin 80 of the human leg. The buffer web 50 provides an excellent elastic buffer effect. When the external force F impacts hardboard 40, the impact force, even though originally focused on one point, is distributed to the two sides of hardboard 40 and stretches the buffer web as a result of the placement of the buffer web 50 and the buffer spacing 501. Thus the external force is distributed uniformly on the buffer web. Further, as the buffer web then has a tendency to wrap around the shin, the external force are effectively reduced and released while the shin experiences but a light indirect shock. In this way, when any position or part of the protector receives an impact, the nylon thread on the holes 41 near the impacted positions will draw the neighboring nylon string to adjust the tightness or looseness of the entire impact face so that the impact force will uniformly distribute over the entire area of the web, and the applied force will be shared, leading to a smaller harmful effect. Thus the protector has an extremely good elastic buffer effect, greatly reducing the impact of the external force onto the shin and providing excellent protection.

Figure 5:
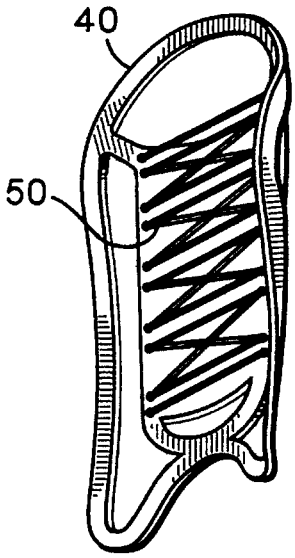
FIG. 5 is an exploded perspective view of another improved shin/ankle protector.
Figure 7:
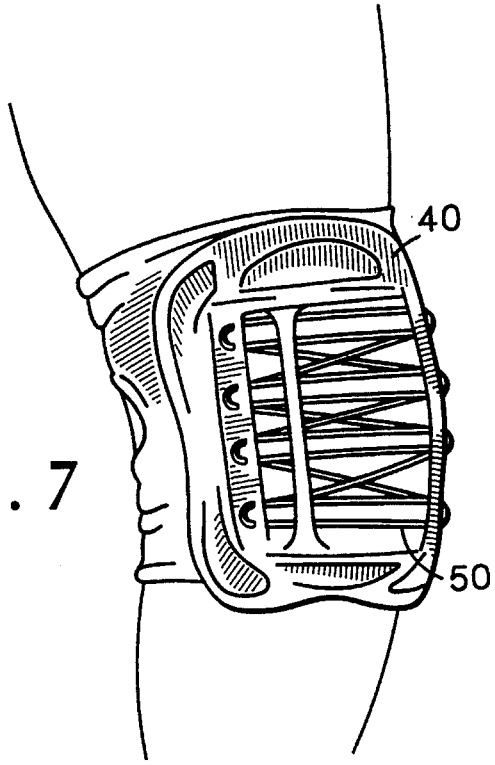
FIGS. 7 through 12 are perspective views of knee, thigh, forearm/hand, elbow, shoulder, and hip protectors, respectively.

FIG. 5 shows another embodiment. The buffer web 50 can be directly formed as a unit with the hardboard 40 by injection molding; this simplifies the manufacturing, reducing costs. Of course, it is also possible to form buffer web 50 as a separate piece and then to sew it onto hardboard 40; the same elastic buffer effect is achieved.

Other embodiments are within the scope of the following claims.

Figure 6:
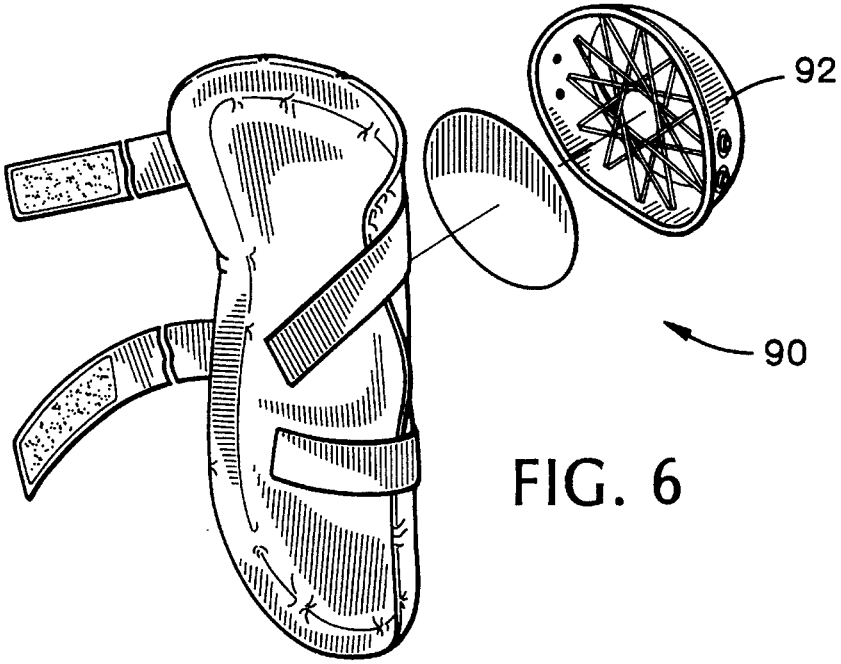
FIG. 6 is an exploded perspective view of a knee protector.
Figure 8:
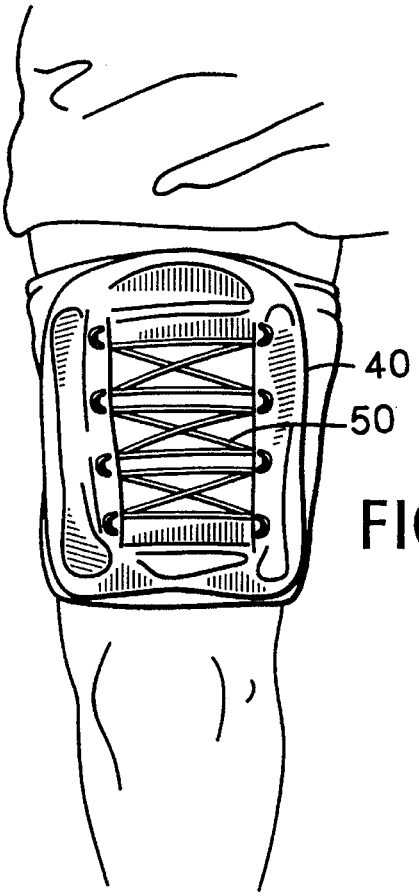
Figure 9:
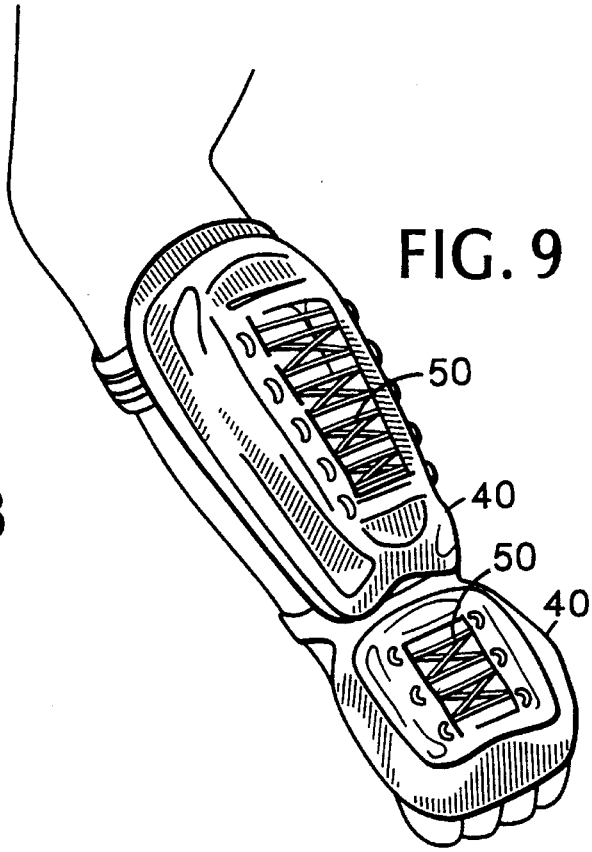
Figure 10:
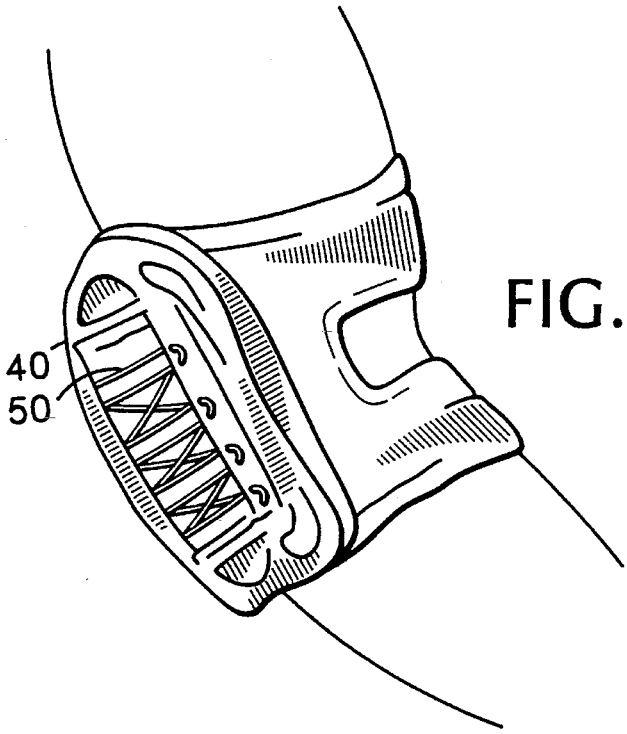
Figure 11:
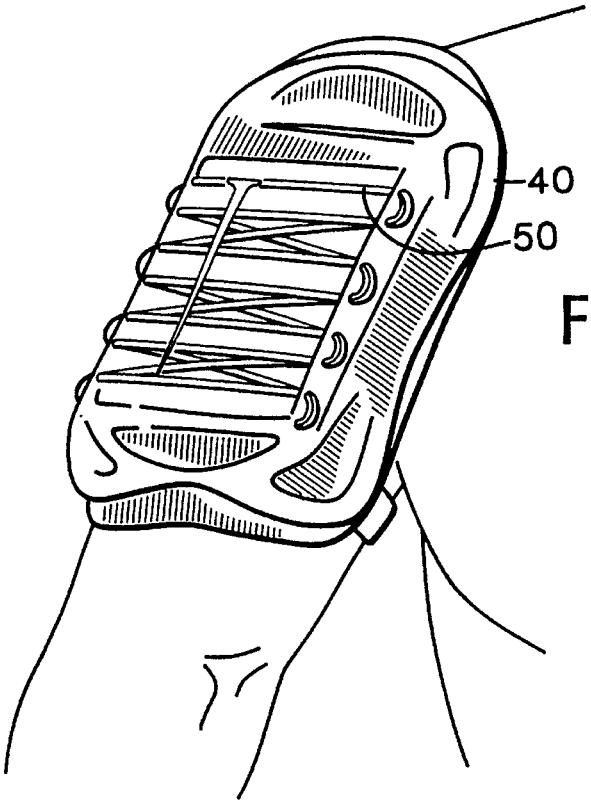
Figure 12:
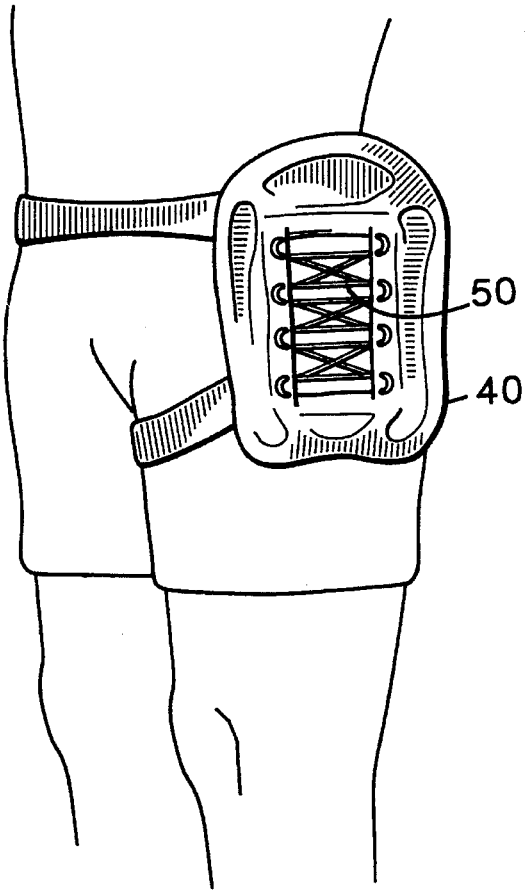

For example, in FIG. 6, in a knee protector, the hardboard 92 is cup shaped and the buffer web 94 is strung on string holes arranged in a circle. Other shapes and configurations may be used for protection of other body parts as seen in FIGS. 7 through 12.

What is claimed is:

1. A buffer structure improvement of a body part protector having a pad, and a board having a generally arcuate cross-section with a string, the improvement characterized in that between the pad and the board in the region of a body part to be protected is a buffer web attached to the board with a buffer spacing between the web and the board, the buffer web being slidably mounted to the board to permit the web to adjust relative to the board in response to an impact.

2. The improvement of claim 1 further characterized in that the buffer web is elastic.

3. The improvement of claim 1 further characterized in that the buffer web lies in a plane.

4. The improvement of claim 1 further characterized in that the buffer web is formed by threads attached to the board.

5. The improvement of claim 1 further characterized in that the board is rigid.

6. The improvement of claim 1 further characterized in that the buffer web comprises a separately formed piece sewn to the board.

7. The improvement of claim 1 wherein the pad, the board, and the web are configured to protect one of the following body parts: shin, knee, ankle, elbow, shoulder, hip, thigh, or forearm/hand.

8. A body part protector comprising a pad, a rigid board having a generally arcuate cross-section, a string attached to the rigid board for holding the board onto the body part, and an elastic buffer web lying in a plane between the board and the pad and with a buffer spacing between the web and the board, said buffer web slidably mounted to the board to permit it to adjust in response to impacts on the board.

* * * * *

UNITED STATES PATENT AND TRADEMARK OFFICE

CERTIFICATE OF CORRECTION

PATENT NO. : 5,491,840

DATED : February 20, 1996

INVENTOR(S) : Fu-Hsin Yen

It is certified that error appears in the above-indentified patent and that said Letters Patent is hereby corrected as shown below:

Col. 2, line 21, "slidably strung" should be --strung slidably--.

Signed and Sealed this

Twenty-seventh Day of May, 1997

*Attest:*

Bruce Lehman

BRUCE LEHMAN

*Attesting Officer*

*Commissioner of Patents and Trademarks*